US005143423A

United States Patent [19]

LeBegue et al.

[11] Patent Number: 5,143,423

[45] Date of Patent: Sep. 1, 1992

[54] DRUM ASSEMBLY FOR A CONTINUOUS MINER

[75] Inventors: Maurice K. LeBegue; Jon C. Blackstock; Clarence H. Woodford, II; Leonard M. Sanders, all of Fairmont, W. Va.

[73] Assignee: Tamrock World Corporation, N.V., Curacao, Netherlands Antilles

[21] Appl. No.: 643,721

[22] Filed: Jan. 18, 1991

[51] Int. Cl.[5] ..... F21C 27/24

[52] U.S. Cl. ..... 299/76; 299/89

[58] Field of Search ..... 299/75, 76, 78, 89

[56] References Cited

U.S. PATENT DOCUMENTS

| | | | |
|---|---|---|---|
| 3,773,384 | 11/1973 | Anderson | 299/76 |
| 3,966,257 | 6/1976 | Shah | 299/76 |
| 4,582,363 | 4/1986 | LeBegue et al. | 299/76 |
| 4,786,112 | 11/1988 | Brandl | 299/76 |

FOREIGN PATENT DOCUMENTS

| | | | |
|---|---|---|---|
| 840347 | 6/1981 | U.S.S.R. | 299/75 |

*Primary Examiner*—David J. Bagnell

*Attorney, Agent, or Firm*—Stanley J. Price, Jr.

[57] ABSTRACT

A cylindrical drum assembly is rotatably mounted transversely on the front of the boom member of a continuous miner. The drum assembly comprises a pair of independently operable drum sections. Each drum section is driven through an input shaft connected to a motor. The drum sections may be connected by a coupler to form a unitary drum assembly which may be operated by only one of the motors. Torque is transmitted from the input shafts to a bevel gear rotatably supported in the drum section. The bevel gear is nonrotatably connected to a sun gear which in turn drives a plurality of planetary gears connected to a cylindrical planetary cage with a bore defining an inner surface. The cage is connected to a cylindrical inner housing on its outer surface and to an output shaft on its inner surface through a cylindrical shear coupler. A puller shaft is provided to remove the output shaft and the shear coupler.

20 Claims, 3 Drawing Sheets

DRUM ASSEMBLY FOR A CONTINUOUS MINER

BACKGROUND OF THE INVENTION

1. Field of the Invention

This invention relates to a drum assembly for use on a continuous mining machine and, more particularly to a drum assembly having a pair of independently operable drum sections which may be joined by a coupler to function as a unitary drum member.

2. Description of the Prior Art

The use of continuous mining machines with drum type dislodging means are well known in the art.

U.S. Pat. No. 3,290,096 discloses a drum assembly for a mining machine having two end portions and an intermediate portion with the intermediate portion containing the motor for driving the drum assembly and reduction gears for reducing the speed of rotation of the drum supported on the extension of a boom assembly extending from the mining machine.

U.S. Pat. No. 3,774,969 discloses a continuous mining machine with a drum member rotatably mounted on the front of a boom member transversely to the body portion of the mining machine with an intermediate portion and canted end portions.

U.S. Pat. No. 3,848,930 discloses a mining machine having a drum assembly extending transversely to the axis of the mining machine frame from a boom member. The drum assembly has an intermediate drum portion and a pair of canted end portions. An input drive shaft having a pinion gear meshes with bevel gears secured to the drum member intermediate portion, and the canted end portions are driven either by gearing meshing with the bevel gears or directly from the bevel gears through a universal type joint.

U.S. Pat. No. 4,225,189 discloses a continuous mining machine with a split intermediate drum portion extending transversely to the axis of the mining machine frame from a boom member and canted end drum portions on either side of the intermediate drum portion. The input drive shaft has a pinion which meshes with a bevel gear in the intermediate drum portion causing the intermediate drum to rotate. The end drum portions are rotated by gearing on the outside annular edge of the intermediate drum portions meshing with gearing on the inside annular edge of the end drum portions.

U.S. Pat. No. 4,253,705 discloses a continuous mining machine with a drum assembly rotatably connected to a boom assembly extending from the frame of the mining machine. The drum assembly has two end portions and a split intermediate portion. Input shafts transmit rotation to each end portion and from the end portions rotation is transmitted to the intermediate portion.

U.S Pat. No. 4,270,803 discloses a continuous mining machine with a boom assembly having a cutter drum assembly extending therefrom transversely to the longitudinal axis of the frame of the mining machine. The cutter drum assembly has an intermediate portion and two end portions and is rotatably mounted on the forward end of the boom assembly. The end portions are canted. The input shaft from the motor transmits rotational force to the end drum portions, from which rotational force is transmitted to the intermediate drum portion by means of a universal joint.

U.S. Pat. No. 4,582,363 discloses a drive assembly for a mining machine cutter drum. The cutter drum assembly is mounted on a boom which extends forwardly from the mining machine frame. The cutter drum assembly is mounted transversely to the longitudinal axis of the mining machine frame, and includes an intermediate portion and two canted end portions. An input shaft transmits rotation to the end drum portion, from which rotation is transmitted to the intermediate drum portion.

Although the prior art discloses cutter drum assemblies having intermediate and end drum portions and transmitting rotation from the end portion of the cutter drum to the intermediate portion of the cutter drum, there remains a need for a cutter drum assembly having independently operable drum sections driven by separate motors.

There also remains a need for a cutter drum having a pair of independent sections that may be joined by a coupler to form a unitary cutter drum and a need to provide a drum assembly with a removable outboard bearing support to facilitate ease of repair and maintenance of the drum assembly.

There is a need for a drum drive assembly with an output shaft having a shear coupling to provide torque to an intermediate drum portion which is accessible from the outboard drum portion wall and has a puller shaft attached thereto to enable removal of the output shaft and/or shear coupling by means of the puller shaft.

SUMMARY OF THE INVENTION

In accordance with the present invention there is provided a drum assembly for use on a continuous mining machine for dislodging material from a mine face. The mining machine includes an elongated body portion and traction devices are provided for propelling the body portion. A boom member is pivotally connected to the body portion and extends forwardly therefrom. A drum member is rotatably mounted on the front of the boom member transversely to the body portion. The drum member has a pair of independently operable drum sections which are rotatably supported upon a fixed housing assembly which extends from the boom assembly.

Each drum section is independently operable by means of an associated motor. The drum sections may be joined by means of a coupler to form a unitary cutter drum.

Transmission of torque from the motors to the drum sections is through an input drive shaft. The input drive shaft has a gear meshing with a gear on the output shaft of the motor. The gear driven by the input drive shaft meshes with a bevel gear rotatably supported within the drum section.

The bevel gear is nonrotatably connected to a cylindrical shaft which is in turn connected to the sun gear of a planetary gear system. The sun gear rotates a plurality of planetary gears concentrically around the axis of the sun gear and between the sun gear and a ring gear connected to the fixed housing.

The planetary gears are mounted in a planetary cage by means of shafts which rotatably support the planetary gears for rotation around the sun gear. The planetary cage has a cylindrical shaft portion with an axial bore extending therethrough. The planetary cage shaft has an inner cylindrical surface and an outer cylindrical surface. The inner cylindrical surface of the planetary cage shaft is connected to the outer surface of a cylindrical shear coupler. The shear coupler has an axially extending bore therethrough which defines an inner cylindrical surface.

The inner cylindrical surface of the shear coupler is nonrotatably connected to an output shaft which extends through the bores in the shear coupler and planetary cage to transmit rotation to another portion of the drum section.

The outer cylindrical surface of the planetary cage is nonrotatably connected to a cylindrical inner housing which is rotatably supported within the fixed housing assembly extending from the boom assembly which rotatably supports the drum assembly. The inner housing has an axially extending bore therethrough defining a cylindrical inner surface. The inner surface of the inner housing is nonrotatably connected to the outer cylindrical surface of the planetary cage shaft for rotation therewith.

Cylindrical outer housing assemblies bearing cutter means on the outer cylindrical surfaces thereof are nonrotatably connected to the inner housing and the output shaft to dislodge material from a mine face.

The outer ends of the drum sections each have end walls retained by snap rings. The innermost output shafts having the shear coupler mounted thereon have pull shafts connected thereto. By removing the snap ring in the end wall, the pull shafts permit removal of the output shafts and the shear couplers.

Outboard bearing supports are bolted onto the boom assembly and extend around each drum section. The drum sections are rotatably supported in the outboard bearing supports.

Accordingly, the principal object of the present invention is to provide a continuous mining machine having a drum assembly with drum sections whereby each drum section is independently operable.

Another object of the present invention is to enable the drum sections to be connected by a coupler to enable the drum assembly to function as a unitary cutter drum assembly.

Yet another object of the present invention is to provide a continuous mining machine with a cutter drum assembly having removable outboard bearing supports supporting the drum assemblies which simplifies maintenance and repair of the internal components of the cutter drum assembly.

A further object of the present invention is to provide a drum drive assembly having an output shaft from one portion of the drum to another portion of the drum so that the output shaft, by means of a pull shaft connected to it, is readily removable for repair and maintenance through an end wall of the drum.

Yet another object of the present invention is to provide a shear coupler with an axially extending bore therethrough and a connection on its outer surface for receiving torque and a connection on its inner surface for transmitting torque to an output shaft extending through the bore in the shear coupler.

These and other objects of the present invention will be more completely disclosed and described in the following specification, the accompanying drawings and the appended claims.

DESCRIPTION OF THE PREFERRED EMBODIMENTS

Figures 1, 2:
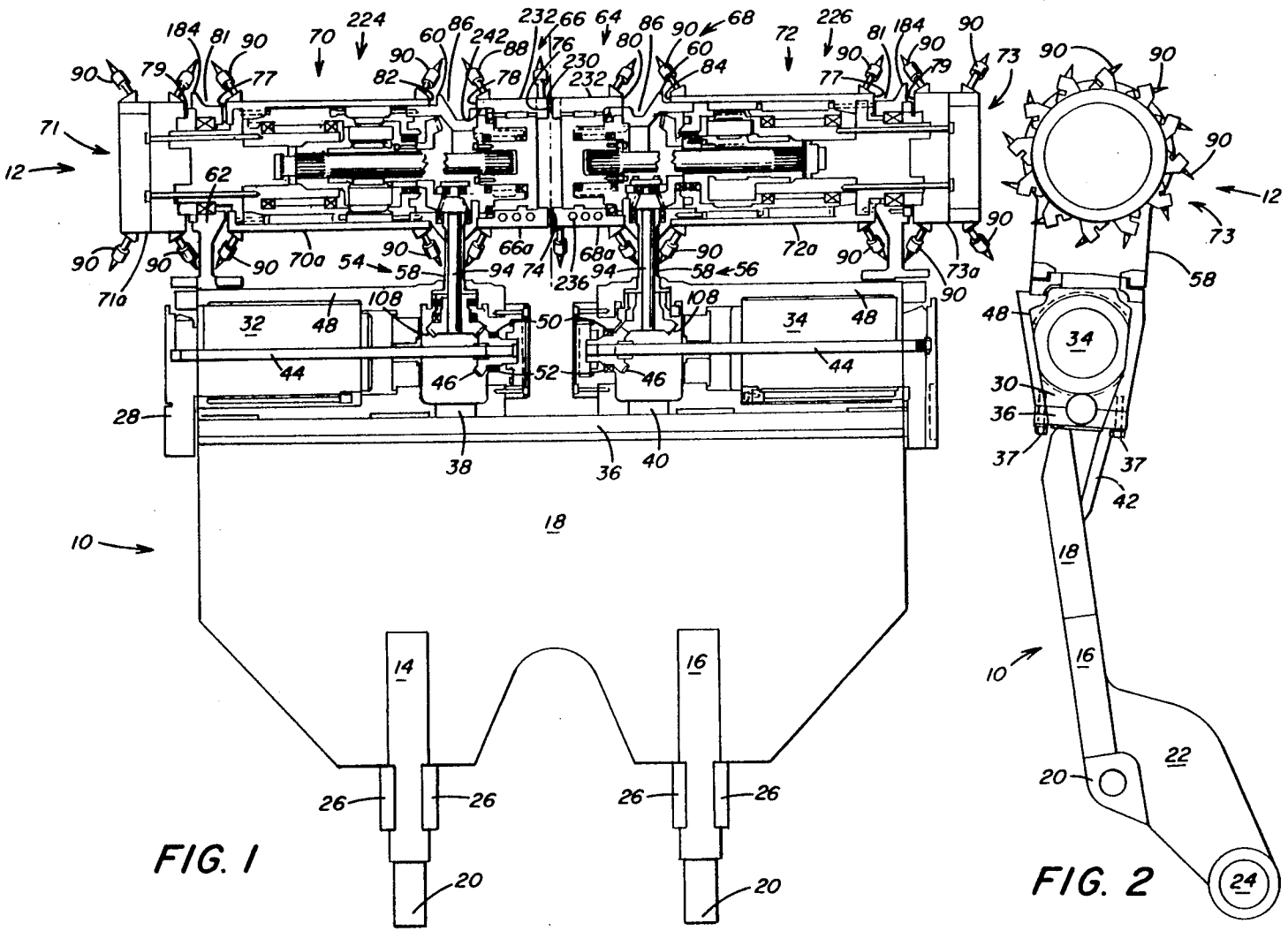
FIG. 1 is a top plan view of a boom assembly, illustrating a drum member having independently operable drum sections.
FIG. 2 is a view in side elevation of the boom assembly illustrated in FIG. 1, and illustrating the position of the motor and the drum assembly relative to each other.

Referring to the drawings and particularly to FIGS. 1 and 2, there is illustrated a boom assembly generally designated by the numeral 10 having a configuration such that it rotatably supports a drum assembly generally designated by the numeral 12. Boom member 10 has a pair of parallel arm members 14 and 16 that extend rearwardly to the mining machine (not shown) body portion and are connected to each other at their front end portions by a transverse housing 18. The mining machine body portion and boom member are known and do not form part of the invention and are therefore not illustrated. The mining machine is a conventional mining machine well known in the art with an elongated body portion or frame, a propulsion means, a conveyor means for transporting mined material rearwardly of the mining machine, and sources of power and controls for operating the mining machine such as the mining machine disclosed in U.S. Pat. No. 4,582,363, incorporated herein by reference. The arm members 14 and 16 are pivotally connected to the mining machine body portion and are also pivotally connected at boom arm end portions 20 to piston rods of piston cylinder assemblies. The piston cylinder assemblies are, in turn, pivotally connected to the mining machine body portion by pivot connections so that the piston assemblies are arranged to pivot the boom member 10 about the respective end portions of the arm members 14 and 16 to move the boom member 10 vertically for an upward or downward shear cut of the mine face by drum assembly 12.

Boom arm members 14 and 16 are pivotally connected to the mining machine frame by means of pivot lever 22 connected at pivot point 24 to the body portion. The pivot levers 22 partially encircle boom arms 14 and 16 at 26 to secure levers 22 to boom arm members 14 and 16.

A second transverse support member 36 is securely connected to boom transverse housing 18.

Second transverse support member 36 supports the gearcases 48 of motors 32 and 34 and is connected thereto by means of bolts 37 which extend through transverse member 36 and into the gearcases or housings 48 of motors 32 and 34. A support strut 42 extends from the undersurface of the boom transverse housing 18 to the lower end of the second transverse support member 36 to provide additional stability and strength to the transverse support member 36. Motors 32 and 34 are set in gearcases 48 which are mounted to the transverse housing 36 transversely to the longitudinal axis of boom member 10.

Apertures 38 and 40 provide access to the interior of gearcases 48. Junction boxes 28 and 30 of each motor 32 and 34 extend laterally and rearwardly of each motor 32 and 34 toward transverse support member 36.

Each motor 32 and 34 has an output shaft 44 with a bevel gear 46 mounted on the extreme outer portion thereof. Bevel gears 46 are rotatably supported within a gearcase 48 by bearings 50 and 52. Fixed housing assemblies generally designated by the numerals 54 and 56 extend forwardly from gearcases 48. With this arrangement housing assemblies 54 and 56 constitute portions of the boom member 10.

Each of the housing assemblies 54 and 56 has an outer annular body portion 58 and a forwardly and outwardly extending portion or core breaker 60 which extends substantially around the front circular periphery of the drum member 12.

Outboard bearing supports 62 extend from the fixed housing assemblies 54 and 56 laterally of the annular portion 58 of the fixed housing assembly 54 and 56. Bearing supports 62 extend annularly around drum assembly 12 end portions to support drum assembly 12.

Drum assembly 12 has an intermediate portion generally designated by the numeral 64 comprising a pair of intermediate members generally designated at 66 and 68 which are spaced from each other. The drum assembly 12 has a pair of main drum portions generally designated at 70 and 72 that extend axially from the respective intermediate portions 66 and 68. The drum assembly 12 is rotatably supported by the fixed housing assemblies 54 and 56 and by outboard bearing supports 62. A pair of outboard drum portions generally designated at 71 and 73 are provided laterally of each outboard bearing support 62.

Figure 3:
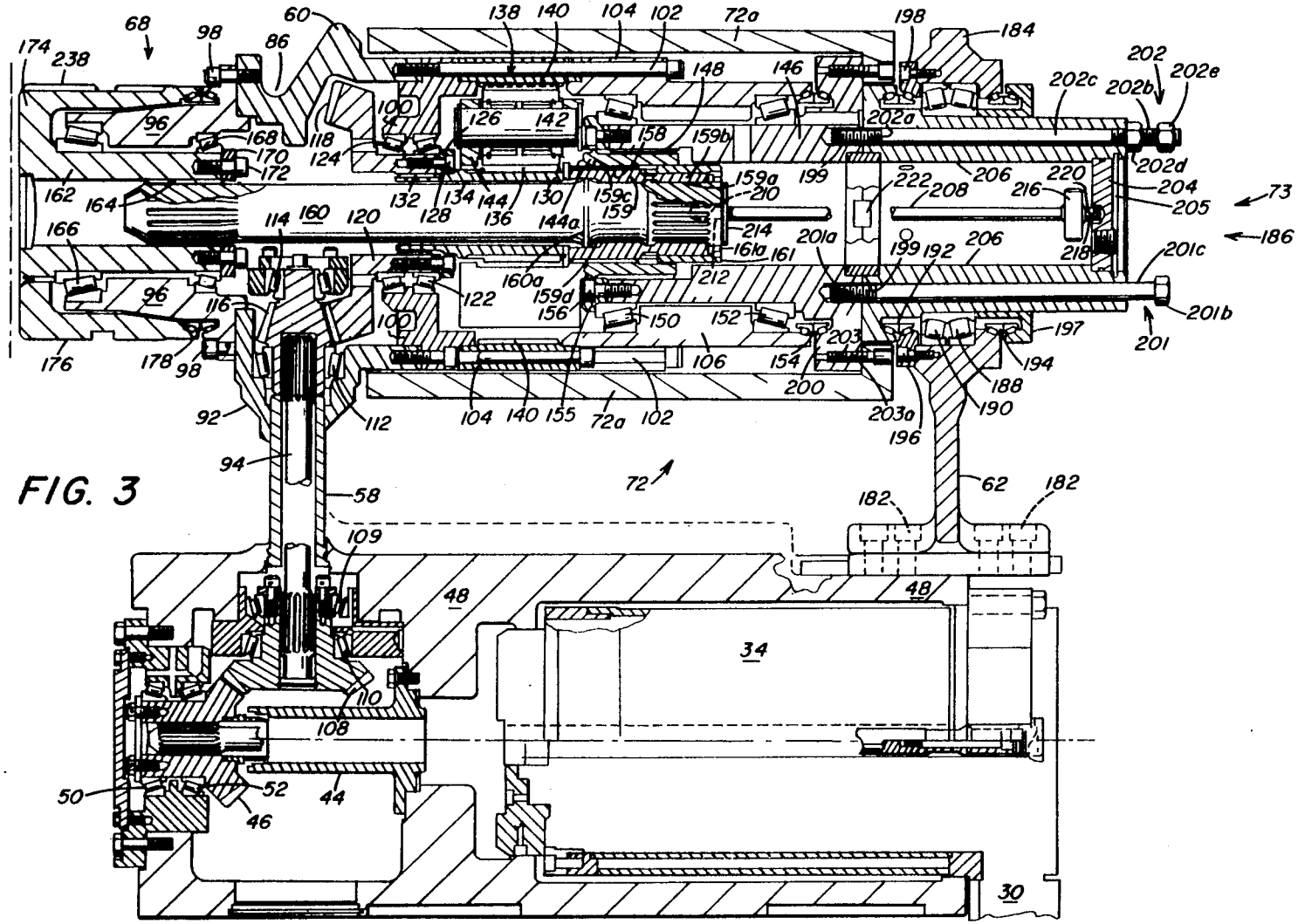
FIG. 3 is a fragmentary view in section of a portion of the drum member, illustrating one of the housing assemblies that extends around the opening in the drum member between the intermediate portion and one of the main drum portions and illustrating the removable outboard bearing support.

The intermediate drum portions 66 and 68 have a cylindrical configuration with inner annular end walls 74 and 76 and outer annular end walls 78 and 80 (FIG. 1). The outer end walls 78 and 80 and the inner end walls 74 and 76 extend perpendicular to the longitudinal axis of the mining machine drum assembly 12. The boom member main drum portions 70 and 72 have a cylindrical configuration with inner annular end walls 82 and 84 that are spaced from and parallel to the outer annular end walls 78 and 80 of the drum member intermediate portions 66 and 68 respectively. With this arrangement, a pair of spaces 86 are formed between the drum member intermediate portions 66 and 68 and the respective main drum portions 70 and 72. FIGS. 1 and 3 illustrate the space 86 between the end wall 80 of the intermediate member 68 and the adjacent end wall 84 of the main drum portion 72.

As illustrated in FIG. 1, main drum portions 70 and 72 also have outer annular walls 77 perpendicular to the longitudinal axis of drum assembly 12 spaced from annular wall 79 of the outboard drum portions 71 and 73 to form space 81 into which outboard bearing supports 62 extend.

As also illustrated in FIG. 1, the drum member intermediate portion 64 has a plurality of cutting elements 88 that extend radially from the outer cylindrical surface of outer cylindrical housings **66*a* and 68*a* of the drum member intermediate portion 64. As illustrated in FIGS. 1 and 2, the drum assembly 12 main portions 70 and 72 and outboard drum portions 71 and 73 also have a plurality of cutting elements 90 that extend radially from the outer cylindrical surfaces of outer cylindrical housings 70*a*, 72*a*, 71*a* and 73*a* of the respective drum assembly 12 portions. Because the drum member main portions 70 and 72 are spaced from drum member intermediate portions 66 and 68, the cutting elements 90 of the main drum portions 70 and 72 are spaced from the adjacent cutting elements 88 of the intermediate portions 66 and 80. The pair of housing assemblies 54 and 56 extend around the spaces 86 between the cutting elements 88 and 90 of the intermediate portions 66 and 68 and the main drum portions 70 and 72** respectively.

Referring to FIG. 3, there is illustrated in section the drive arrangement for the drum member intermediate portion 68, the main drum portion 72, the outboard drum portion 73 and the housing assembly 56. It should be understood that the drive gearing for the other drum member intermediate portion 66, main drum portion 70 and outboard drum portion 71 is similar to that illustrated in FIG. 3, and the other housing assembly 54 is similar to the housing assembly 56, also shown in FIG. 3. Therefore, in FIG. 3 the description will be confined to the drive means for the drum member intermediate portion 68, main drum portion 72, outboard drum portion 73 and housing assembly 56.

In FIG. 3 the housing assembly body portion 56 extends forwardly from the boom member 10 and includes a support housing 92 through which an input drive shaft 94 extends from the motor 34 into the space 86. The support housing 92 forms the gearcase for the drum section drive as will be explained later in greater detail.

The housing assembly 56 includes an inturned flange portion 96 in underlying relation with intermediate drum portion 68. Flange 96 is secured to fixed housing assembly 56 by means of bolts 98. The housing assembly 56 also includes a bearing support 100 secured to housing assembly 56 by means of bolts 102. Bolts 102 also secure flange 104 and support member 106 in underlying relation with the drum member main drum portion 72.

As rotational force is transmitted from the motor 34 through motor shaft 44, bevel gear 46, which is splined to motor shaft 44, meshes with bevel gear 108 to transmit rotational force to input shaft 94. Bevel gear 108 is rotatably supported within the gearcase 48 of the fixed housing assembly 56 by bearings 109 and 110 and a pinion 116 is rotatably supported by bearings 112 and 114. Pinion 116 is splined to input shaft 94 upper end. As input drive shaft 94 is rotated within bearings 109, 110, 112 and 114, pinion 116, which is splined onto the top end portion of input drive shaft 94, meshes with bevel gear 118. Bevel gear 118 transmits rotational force from input drive shaft 94 to shaft portion 120 which is rotatably supported within bearing support 100 by bearings 122 and 124. Bearing 122 is held in place by a bearing support 126 secured to shaft 120 by bolt 128. Shaft 120 is splined into cylindrical shaft 130 at 132. Shaft 130 has a cylindrical configuration and has axially extending cylindrical bore 134. Shaft member 130 has a sun gear 136 nonrotatably connected thereto.

Sun gear 136 meshes with a plurality of planetary gears generally designated at 138 which also mesh with the teeth of a ring gear 140. Ring gear 140 is nonrotatably secured to the inner surface of flange 104. Planetary gears 138 are secured about shafts 142 which are in turn secured within a planetary cage 144. As the sun gear 136 is rotated upon shaft 130, planetary gears 138 rotate concentrically about the axis of sun gear 136 within the fixed ring gear 140. Planetary cage 144 is rotated about the axis of sun gear 136 by the movement of the planetary gears 138 which are tied to the planetary cage 144 by means of shafts 142. Planetary cage 144 has a tubular shaft portion 144*a* which is splined into inner tubular housing or first output shaft 146 at 148. Inner tubular housing 146 is rotatably positioned within the fixed housing assembly 56 in underlying relation with the support member 106 by means of bearings 150 and 152. Seals 154 seal the space between the inner housing 146 and the support member 106. An annular bearing support 155 is connected to inner tubular housing 146 by bolt 156.

Rotation is also transmitted from planetary cage 144 at splined portion 158 on the inner surface of planetary cage shaft portion 144*a* to shear shaft 159 through spline 159*c* on shear shaft 159 outer surface. Shear shaft 159 is splined on its inner surface at 159*a* to a second output shaft 160, and has a portion 159*b* of reduced cross section designed to shear in the event that the torque on shear shaft 159 exceeds a preset limit to prevent damage to the internal components of the drum drive assembly as disclosed in U.S. Pat. No. 4,582,363 which is incorporated herein by reference.

Bushing 161 surrounds shear shaft 159 and maintains shear shaft 159 in position around shaft 160 even if portion 159*b* is sheared. Bushing 161 is retained on shaft 160 by a snap ring 161*a*.

Shaft 160 has an enlarged annular portion 160*a* which fits into an enlarged bore portion 159*d* in shear shaft 159. With this arrangement, even should shear shaft 159 be sheared at 159*b*, both halves of shear shaft 159 may be removed from cylindrical bore 134 as will be explained hereinbelow in greater detail.

Shaft 160 extends from main drum section 72 through bore 134 into space 86 and into intermediate drum support member 162 which is splined onto shaft 160 at 164. Intermediate drum support member 162 is rotatably supported within the inturned flange portion 96 by means of bearings 166 and 168. Bearing 168 is supported by an annular bearing support 170 which is bolted onto the intermediate drum support member 162 by means of bolts 172. Intermediate drum support member 162 has an axially extending flange portion 174 which extends laterally from and parallel to intermediate drum support member 162. The outer cylindrical surface 176 of flange 174 is adapted to be connected to outer drum housing 68*a* to impart rotation to the outer drum housing 68*a* for removing material from a mine face. Seals 178 seal the space between the intermediate drum support member 162, the intermediate drum support flange 174 and the inturned flanged portion 96 to protect the internal components of the drum member 12 from dust and abrasive pollutants.

As illustrated in FIGS. 1 and 3, an outboard bearing support 62 is anchored to motor housing portion 48 by means of bolts 182. Bearing support 62 has an annular end portion 184 which surrounds a cup shaped end cap generally designated at 186 of boom member outboard drum portion 73. End cap 186 is rotatably maintained within the annular end portion 184 of bearing support 62 by means of bearings 188 and 190. End cap 186 is designed to support the outer cylindrical housing 73*a* of the outboard drum portion 73 with cutter bits 90 extending therefrom for removing material from a mine face. Seals 192 and 194 seal the spaces between bearing support 62 annular end portion 184 and end cap 186. Annular seal support 196 supports seal 192 and is bolted onto bearing support 62 annular end portion 184 by means of bolt 198. Annular seal support 197 supports seal 194 and is pressed to the outer cylindrical surface of the end cap 186. End cap 186 is bolted onto inner housing outer shaft 146 by means of a plurality of bolts generally designated at 201 and 202. End cap 186 is also secured to inner housing output shaft 146 by means of keys 222.

Bolts 201 have a threaded end portion 201*a* which is received within threaded bore 199 in inner housing 146 to retain end cap 186 and outer cylindrical housing 73*a* thereon. Bolts 201 have a headed end 201*b* spaced from threaded end 201*a* by a shaft portion 201*c*. Headed end 201*b* engages end cap 186 and outer housing 73*a* around an aperture in end cap 186 and outer housing 73*a* to retain end cap 186 and outer housing 73*a* upon inner housing 146.

A plurality of bolts 202 have a threaded end 202*a* and are also received in threaded bores 199 to retain end cap 186 upon inner housing 146. Bolts 202 also have an nut-retaining threaded end portion 202*b* spaced from threaded end 202*a* by shaft portion 202*c*. Nuts 202*d* and 202*e* are threaded on end portion 202*b*. Nut 202*d* allows end cap 186 to be tightened upon inner housing 146. Nut 202*e* allows nonrotatable retention of the outer cylindrical housing 73*a* on the outboard drum portion 73 (see FIG. 1) upon end cap 186 and removal of outboard housing 73*a* on outboard drum portion 73 from end cap 186 without the necessity of removing end cap 186 from inner housing 146.

An end wall 204 connects the side walls 206 of the end cap 186. A pull shaft 208 of minor diameter has a threaded end portion 210 threaded into a threaded bore 212 in the center of the end wall portion of shaft 160. A flange 214 adjacent to the threaded end 212 of pull shaft 208 abuts the end wall portion of shaft 160. Shaft 208 has an integrally formed transverse short shaft 216 near the end of pull shaft 208 opposite threaded end 210. The end portion 218 of shaft 208 opposite threaded end portion 210 extends into and is rotatably supported by a bore 220 in end wall 204. With this arrangement, pull shaft 208 rotates in tandem with shaft 160. A snap ring 205 maintains end wall 204 in position in end cap 186. Also with this configuration, when the snap ring 205 is removed from the end wall 204, the end wall may be removed to enable repair of the internal components of the drum drive assembly 12. Pull shaft 208 is conveniently utilized to remove shaft 160 to enable access to the internal components of the drum assembly 12 and shear shaft 159 for maintenance and repair. The enlarged annular portion 160*a* of shaft 160 engages the wall 159*d* of enlarged bore 159*c* in shear shaft 159 to remove shear shaft 159 with shaft 160. Bushing 161 retains the portion 159*b* of reduced cross section of shear shaft 159 and upon shaft 160 for removal therewith even if portion 159*b* is sheared from the rest of shear shaft 159.

Referring to FIG. 1 it should be apparent from the foregoing description of the preferred embodiment that each outboard drum portion 71 and 73, each adjacent main drum portion 70 and 72 and adjacent intermediate portions 66 and 68 are independently operable from motors 32 and 34. Thus, motor 32 is operable to rotate main drum portion 70 which transmits rotation to intermediate portion 66 and outboard drum portion 71, and motor 34 transmits rotation to main drum portion 72, which transmits rotation to intermediate drum portion 68 and outboard drum portion 73, to provide the continuous mining machine with a first independently operable drum section generally designated at 224 and a second independently operable drum section generally designated at 226.

Figure 7:
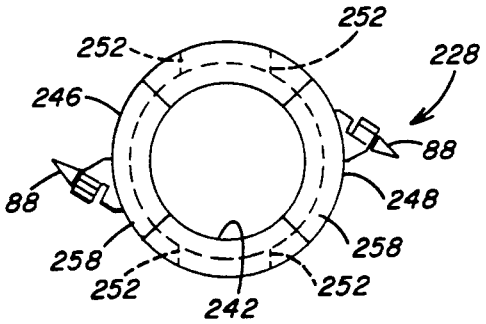
FIG. 7 is a view in section of the coupler for joining the sections of the drum assembly.

First independent drum section 224 may be joined to second independent drum section 226 by means of coupler 228 (FIGS. 4 through 7) to form a unitary drum assembly 12. As illustrated in FIGS. 1 and 3, intermediate drum member 64 comprises intermediate drum portion 66 and intermediate drum portion 68 which are separated by gap 230 formed between the inner end wall 74 of intermediate drum portion 66 and the inner end wall 76 of intermediate drum portion 68. Intermediate drum portions 66 and 68 include inturned flange portions 96 which project from fixed housing assemblies 54 and 56 for rotatably supporting the intermediate drum support members 162. Intermediate drum support members 162, which rotate through transmission of torque through motors 32 and 34 as hereinabove described, support the intermediate drum assembly outer housings 66*a* and 68*a*. Each intermediate drum support member 162 nonrotatably supports intermediate drum assembly housings 66*a* and 68*a*, and each intermediate drum portion 66 and 68 is separated by gap 230 formed between the inner end walls 74 and 76 of intermediate drum portions 66 and 68. With this arrangement of independent drum sections 224 and 226, each portion 66 and 68 is driven by shaft 160 through an adjacent main drum portion 70 and 72, which enables independent operation of independent drum sections 224 and 226. Each intermediate drum assembly housing 66*a* and 68*a* is formed of half portions 232 which support cutting elements 88 extending from the exterior cylindrical surfaces thereof. Intermediate drum assembly housing portions 232 are joined to each other by bolts 236 extending therethrough. By means of bolts 236, each intermediate drum assembly housing 232 is clampingly engaged with the outer cylindrical surface 176 of the intermediate drum support member 162. Outer cylindrical surface 176 also includes a key portion 238 to fit into keyways (not shown) in intermediate drum assembly housing inner cylindrical surface 242 (see FIGS. 4 and 7) and outer cylindrical surface 176 to prevent rotation of intermediate drum assembly housings 66*a* and 68*a* relative to the intermediate drum support member 162. As the intermediate drum assembly housings 66*a* and 68*a* are in two parts 232, ease of assembly and disassembly of intermediate drum member 64 is facilitated thereby.

Figure 4:
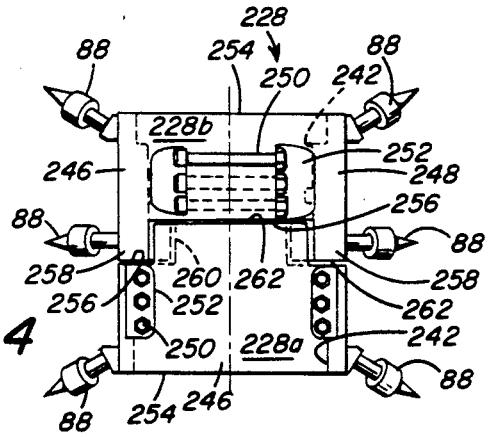
FIG. 4 is a top plan view in section of the coupler for joining the intermediate portions of the drum sections to enable the drum sections to function as a unitary drum assembly.
Figure 5:
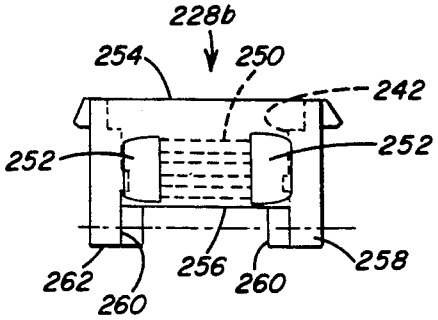
FIG. 5 is a top plan view in section of one half of the coupler for joining the drum sections.
Figure 6:
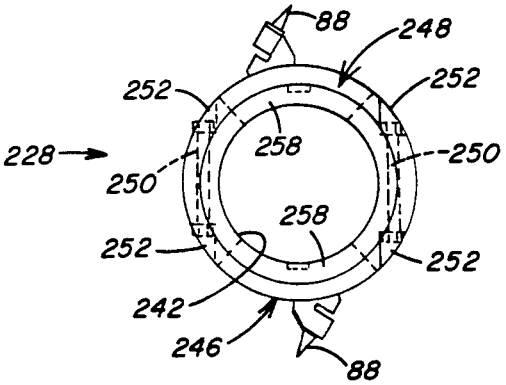
FIG. 6 is a view in section of the jaw type coupler and illustrating the halves of the coupler joined by bolts.

Referring now to FIGS. 4, 5, 6, and 7 there is illustrated a coupler 228 for connecting the first independently operable drum section 224 to the second independently operable drum section 226 to facilitate the transformation of drum assembly 12 from an independently operable drum assembly into a unitary cutter drum assembly. Coupler 228 consists of two interfitting members 228*a* and 228*b* which each fit around one intermediate drum support member 162 as best illustrated in FIG. 4. Each interfitting member 228*a* and 228*b* comprises two half portions 246 and 248 which are tied together by bolts 250. Each bolt 250 passes through a bore in a cup shaped bolt retainer 252 which is either formed integrally with each half portion of the coupler 246 and 248, or is securely bolted thereto. Each half portion 246 and 248 has two cup shaped bolt retainers 252 opposite each other and aligned with two bolt retainer 252 in the other half portion 246 or 248 for connecting each half portion around an intermediate drum support member 162. Each half portion of the coupler 246 and 248 has an outer annular end wall 254 which is generally perpendicular to the longitudinal axis of drum assembly 12 and an inner annular end wall 256. Inner annular end walls 256 of each half portion of the coupler 246 and 248 have a projection 258 extending partially along end wall 256 and formed integrally with each half portion 246 and 248. Projection 258 extends above the inner annular end wall 256 surface, and has edge surfaces 260 and end surface 262. Each projection 258 of each half portion 246 and 248 of the coupler 228 are adjacent to the inner annular end wall 256 of the adjacent half portion 246 and 248 of the coupler 228, and the edge surfaces 260 of each adjacent interfitting member 228*a* are adjacent to the edge surfaces 260 of the adjoining interfitting member 228*b* to prevent relative rotation between each interfitting member 228*a* and 228*b*.

In operation, to convert the drum assembly 12 from an independently operable drum drive assembly to a unitary drum drive assembly, intermediate drum assembly housing portions 232 are removed from the intermediate drum sections 66 and 68 by removing bolts 236. Each half portion 246 and 248 of the coupler 228 interfitting members 228*a* and 228*b* are joined to each intermediate drum support member 162 by means of bolts 250 which extend through the bolt retainers 252 in each half portion 246 and 248 such that the projection 258 from each assembled interfitting member 228*a* and 228*b* are adjacent to and may abut the inner annular end wall 256 of each adjacent interfitting member of coupler 228, and the edge surfaces 260 of each projection 258 are adjacent to and may abut the other edge surfaces 260 to prevent relative rotation of interfitting members 228*a* and 228*b*.

According to the provisions of the Patent Statutes, we have explained the principal, preferred construction and mode of operation of our invention and have illustrated and described what we now consider to represent its best embodiments. However, it should be understood that, within the scope of the appended claims, the invention may be practiced otherwise than as specifically illustrated and described.

We claim:

1. A drum assembly for a continuous mining machine,
a boom member on a mining machine,
a cutter drum assembly rotatably mounted on the front of said boom member,
said cutter drum assembly including a first drum end portion and a second drum end portion,
said first and second drum end portions being adjacently positioned in spaced relation to form a pair of independent drum sections,
input drive means for rotating said first and second drum end portions so that said pair of independent drum sections rotate independently of each other,
cutting elements positioned on said drum sections, and
said drum sections arranged to dislodge material from a mine face upon rotation of said respective sections.

2. The drum assembly for a continuous mining machine as set forth in claim 1 which includes,
means for connecting said drum sections together to operate as a unitary drum assembly.

3. The drum assembly for a continuous mining machine as set forth in claim 2 which includes,
coupler means for connecting said drum sections.

4. The drum assembly for a continuous mining machine as set forth in claim 3 in which, a coupler for connecting said sections, a portion of said coupler being connected to each adjacent end of said sections, and said coupler comprising two interfitting portions.

5. The drum assembly for a continuous mining machine as set forth in claim 1 in which, said drive means including a pair of shafts connected to a pair of said motors for transmission of torque therefrom, each of said sections having at least one said motor for rotating said sections, said sections being rotatably mounted upon a fixed housing assembly, said fixed housing assembly extending from said boom member, said input drive means extending into one of said sections, said input drive means extending into said section having a first gear thereon to transmit rotation to a second gear, and said second gear rotatably mounted within said drum section.

6. The drum assembly for a continuous mining machine as set forth in claim 5 in which, the connection between said motor and said input drive means being a third gear on said input drive means meshing with a fourth gear on the output shaft of said motor.

7. The drum assembly for a continuous mining machine as set forth in claim 5 in which, said second gear arranged to rotate a sun gear within said drum section, said sun gear arranged to rotate a plurality of a planetary gears concentrically around the axis of said sun gear between said sun gear and a ring gear, said ring gear being nonrotatably connected to said fixed housing assembly, said sun gear having an axially extending bore therethrough, said plurality of planetary gears connected to a planetary gear cage and arranged to rotate said planetary gear cage, said planetary gear cage having a planetary shaft portion with a cylindrical configuration and a bore extending axially therethrough, an inner cylindrical surface and an cylindrical outer surface, said planetary shaft portion nonrotatably connected on said outer cylindrical surface thereof to a first output shaft, said first output shaft being rotatably supported within said fixed housing assembly, said first output shaft having a cylindrical configuration with an axially extending cylindrical bore forming a cylindrical inner surface and a cylindrical outer surface, said cylindrical inner surface of said first output shaft nonrotatably connected to said outer cylindrical surface of said planetary gear cage for rotation therewith, said inner surface of said planetary gear cage being nonrotatably connected to a second output shaft, and said second output shaft extending through the bore in said planetary gear cage and the bore in said first output shaft.

8. The drum assembly for a continuous mining machine as set forth in claim 7 in which, said second output shaft is connected to said planetary gear cage through a shear coupler.

9. The drum assembly for a continuous mining machine as set forth in claim 8 in which, said shear coupler having a cylindrical configuration with an axial bore therethrough, a cylindrical inner surface and a cylindrical outer surface, and said cylindrical outer surface of said shear coupler being nonrotatably connected to said cylindrical inner surface of said planetary shaft portion and said cylindrical inner surface of said shear coupler being nonrotatably connected to said second output shaft.

10. The drum assembly for a continuous mining machine as set forth in claim 9 in which, said shear coupler comprising an end portion connected to a portion of reduced cross section.

11. A drum assembly for a continuous mining machine as set forth in claim 10 in which, a bushing arranged to retain said portion of reduced diameter upon said second output shaft in the event said portion of reduced diameter shears from said end portion of said shear coupler, said portion of reduced cross section being within said bushing, and said bushing being retained upon said second output shaft between a snap ring and said end portion of said shear coupler.

12. A drum assembly for a continuous mining machine as set forth in claim 7 in which, said drum sections having an outboard end and an inboard end, said outboard end being furthest from the other said drum section and said inboard end being adjacent the other said drum section, said second output shaft having an outer cylindrical surface, said second output shaft having an enlarged annular portion of said outer cylindrical surface, said shear coupler having an enlarged bore portion accommodating said enlarged annular portion of said second output shaft, said second output shaft having an end wall spaced from the other end of said second output shaft by a body portion, said end wall being nearer said outboard end of said drum section than said other end of said second output shaft, and said portion of reduced cross section of said coupler surrounding said second output shaft adjacent said end wall.

13. The drum assembly for a continuous mining machine as set forth in claim 12 in which, said second output shaft having a pull shaft connected to said end wall of said second output shaft.

14. The drum assembly for a continuous mining machine as set forth in claim 13 in which, said outboard end of said drum section having a removable terminal wall, and said removable terminal wall of said drum section being retained upon said drum section by a snap ring.

15. The drum assembly for a continuous mining machine as set forth in claim 14 in which, said pull shaft being rotatably supported in a bore in said removable terminal wall.

16. The drum assembly for a continuous mining machine as set forth in claim 14 in which, said pull shaft being connected to said inner annular housing for rotation therewith, and said pull shaft being nonrotatably connected to said end wall of said second output shaft.

17. A drum assembly for a continuous mining machine as set forth in claim 7 in which, said second output shaft having a pull shaft connected thereto, said drum section having a removable terminal wall having a configuration such that said removable terminal wall provides access to said pull shaft, and said second output shaft and said pull shaft having a configuration such that said second output shaft may be removed by means of said pull shaft.

18. A drum assembly for a continuous mining machine as set forth in claim 17 in which, said pull shaft is rotatably supported within a bore in said removable terminal wall.

19. A drum assembly for a continuous mining machine comprising, a boom member on a mining machine, a pair of drum sections rotatably mounted on the front of said boom member, said drum sections having adjacently positioned end portions, cutting elements positioned on said drum sections for dislodging material from a mine face, a coupler for connecting said adjacently positioned end portions to join together said drum sections and form a unitary cutter drum assembly, a portion of said coupler being connected to each adjacent end portion of said drum sections, said coupler comprising two interfitting portions, and input drive means for transmitting rotation to said drum sections to rotate said unitary cutter drum assembly to dislodge material from a mine face.

20. A drum assembly for a continuous mining machine comprising, a boom member on a mining machine, a pair of drum sections rotatably mounted on the front of said boom member, cutting elements positioned on said drum sections for dislodging material from a mine face, a pair of motors for transmission of torque to said pair of drum sections respectively to independently rotate said drum sections, a pair of shafts connected to said pair of motors for transmission of torque therefrom, a fixed housing assembly extending from said boom member, said drum sections being rotatably mounted upon said fixed housing assembly, said pair of shafts extending through said housing assembly from said pair of motors to said pair of drum sections respectively, said pair of shafts extending into said drum sections and each of said shafts having a first gear thereon to transmit rotation to a second gear, said second gear being rotatably mounted within said respective drum section, a sun gear rotatably positioned within said respective drum section and said second gear connected to rotate said sun gear, a ring gear nonrotatably connected to said fixed housing assembly, said sun gear connected to rotate a plurality of planetary gears concentrically around the axis of said sun gear between said sun gear and said ring gear, said sun gear having an axially extending bore therethrough, said plurality of planetary gears connected to a planetary gear cage for rotating said planetary gear cage, said planetary gear cage having a planetary shaft portion with a cylindrical configuration and a more extending axially therethrough, an inner cylindrical surface and an outer cylindrical surface, said planetary shaft portion being nonrotatably connected on said outer cylindrical surface thereof to a first output shaft, said first output shaft being rotatably supported within said fixed housing assembly, said first output shaft having a cylindrical configuration with an axially extending cylindrical bore forming a inner cylindrical surface and an outer cylindrical surface, said inner cylindrical surface of said first output shaft being nonrotatably connected to said outer cylindrical surface of said planetary gear cage for rotation therewith, said inner cylindrical surface of said planetary gear cage being nonrotatably connected to a second output shaft, and said second output shaft extending through the bore in said planetary gear cage and the bore in said first output shaft.

* * * * *